United States Patent [19]

Winer

[11] 4,273,181

[45] Jun. 16, 1981

[54] CENTRIFUGAL CASTING MACHINE

[75] Inventor: Irving G. Winer, Yucaipa, Calif.

[73] Assignee: The J. M. Ney Company, Bloomfield, Conn.

[21] Appl. No.: 89,523

[22] Filed: Oct. 30, 1979

[51] Int. Cl.[3] ..... B22D 13/00

[52] U.S. Cl. ..... 164/114; 164/287; 164/289

[58] Field of Search ..... 164/114–118, 164/286–297, DIG. 4

[56] References Cited

U.S. PATENT DOCUMENTS

| | | | |
|---|---|---|---|
| Re. 17,783 | 8/1930 | Gardner | 164/289 |
| 1,009,167 | 11/1911 | Monson | 164/287 |
| 1,195,803 | 8/1916 | Gardner | 164/289 X |
| 1,517,609 | 12/1924 | Atkins | 164/287 |
| 1,944,435 | 1/1934 | Kerr | 164/287 |
| 2,011,955 | 8/1935 | Touceda | 164/289 X |
| 2,418,852 | 4/1947 | Rothstein | 164/287 X |
| 2,451,163 | 10/1948 | Goin | 242/107.7 |
| 2,509,670 | 5/1950 | Capita | 164/287 X |
| 2,637,079 | 5/1953 | Kemppe | 164/287 X |
| 2,665,008 | 1/1954 | Call | 164/289 X |
| 2,752,650 | 7/1956 | Bosna | 164/287 |

FOREIGN PATENT DOCUMENTS

| | | | |
|---|---|---|---|
| 940287 | 12/1948 | France | 164/289 |

*Primary Examiner*—Robert D. Baldwin
*Assistant Examiner*—K. Y. Lin

[57] ABSTRACT

A centrifugal-casting machine includes a rotatable subassembly that has a generally planar support plate extending perpendicularly to the axis of rotation and a generally cylindrical shield portion extending from the periphery of the support plate. The shield rotates with the rotatable subassembly. A handle means slides in a track on the support plate and has a handle portion and a catch portion. In one position of the handle means, the catch portion engages a stop portion of the base in which the rotatable subassembly is journaled, and in the other position the catch portion does not engage the stop portion, so the rotatable subassembly can rotate freely. Winding, locking, and release can thereby all be effected by manipulation of the handle portion of the handle means.

8 Claims, 8 Drawing Figures

CENTRIFUGAL CASTING MACHINE

BACKGROUND OF THE INVENTION

The present invention relates to centrifugal-casting machines, particularly those directed to the hobbyist market.

In centrifugal casting, the molten material to be cast is heated in a crucible that communicates with a mold. The crucible and mold are mounted in a rotatable assembly, the assembly rotates, and centrifugal force causes the material from the crucible to flow into the mold. This type of casting is employed for various purposes, but the type of centrifugal-casting machine described in the following specification is intended primarily for the hobby market to be used, for instance, to make jewelry.

Two important considerations in the design of centrifugal-casting machines for these purposes are simplicity and safety. It is of course important that the user of the device be protected when a crucible and mold filled with hot material are spun at a high velocity. It is additionally important that the device be simple to use so that the home hobbyist need not develop a high degree of skill in order to operate the machine. It is accordingly an object of the present invention to afford both safety and simplicity in operation. It is a further object of the present invention to provide these features in a machine so designed that its cost of manufacture is low enough to put it within the financial means of the hobbyist.

SUMMARY OF THE INVENTION

The foregoing and related objects are achieved in a centrigufal-casting machine that includes a base and a rotatable subassembly journaled in the base for rotation relative to it about an axis. The rotatable subassembly has mounting means on it spaced transversely from the axis and adapted for mounting a centrifugal-casting crucible and mold. The machine has drive means including drive spring means. The drive means are operatively connected to the base and the rotatable subassembly for winding of the drive spring means by rotation of the rotatable subassembly relative to the base in one direction and for urging of the rotatable subassembly in the other direction by the drive spring means when it is wound. The drive means permit the rotatable subassembly to rotate in the other direction without winding the drive spring means.

Handle means are included that have a handle portion adapted to be manually gripped by the user. The handle means are slidably mounted on the rotatable subassembly for sliding movement radially thereof from a first position, in which the handle portion is spaced farther from the axis, to a second position, in which the handle portion is positioned closer to the axis.

Cooperating locking means on the base and the handle means are engageable upon movement of the handle means to the second position to prevent rotation of the rotatable subassembly relative to the base in the other direction and disengageable upon movement of the handle means to the first position permit such rotation. Winding, locking, and release can thereby all be effected by manipulation of the handle means.

The locking means can conveniently include both a catch portion of the handle means that extends from it. It can also include a stop portion of the base positioned to obstruct movement of the catch portion about the axis when the handle portion is in the second position but to permit movement of the catch portion when the handle portion is in the first position.

The rotatable subassembly preferably includes a generally planar plate portion extending substantially perpendicularly to the axis, having an opening through it at least part of which is spaced from the axis, and including track means on it that extend substantially radially from the opening. The handle means in such an arrangement include a body portion received in the track means for guiding of the handle means by the track means radially of the axis. The catch portion of the handle means extends in one direction transversely of the body portion from its one end through the opening. The handle portion of the handle means extends in the other direction transversely of the body portion from the other end of the body portion. Bias means would ordinarily be included for biasing the handle means to its first position.

The base may include a housing having a generally planar upper surface and at least one upstanding rib projecting from the upper surface and extending from the axis toward the periphery of the upper surface. The rib extends a predetermined limit distance from the axis, and the catch portion of the handle means is spaced more than the limit distance from the axis when the handle means is in the first position. It is spaced less than the limit distance from the axis when the handle means is in the second position. In the preferred embodiment, the housing of the base includes a second upstanding rib projecting from the upper surface and extending approximately in the direction opposite the first-mentioned rib from the axis toward the periphery of the upper surface. The second rib extends approximately the predetermined limit distance from the axis.

The rotatable subassembly can also include shaft means journaled in the base for rotation about the axis. One end of the drive spring means is fastened to the base, and the drive means include clutch means coupled between the shaft and the other end of the drive spring means for permitting the shaft to slip relative to the other end of the drive spring means in one direction but prevent it from slipping relative to the other end of the drive spring means in the other direction. Winding of the drive spring means by rotation of the rotatable subassembly is thereby possible in only one direction.

The method of operating a centrifugal-casting machine is thereby taught that includes the steps of providing such a centrifugal-casting machine and, with the handle means in the first position, urging the handle portion and the axis in the one direction, thereby winding the drive spring means. The handle portion is then moved to the second position to engage the cooperating locking means, and a charge of material is heated in the crucible to a molten state. The handle portion is moved to the second position and released, and the drive means is thereby permitted to rotate the rotatable subassembly.

Also taught below is an improvement in centrifugal-casting machines of the type that includes a base, a rotatable subassembly journaled in the base for rotation about an axis and including mounting means for mounting a crucible and mold spaced transversely from the axis, and drive means for rotataing the rotatable subassembly about the axis relative to the base. According to the invention, the rotatable subassembly includes a support portion rotatable about the axis and a shield portion extending about the support portion for rotation with it. The shield portion extends away from the base portion, is spaced outwardly from the axis, and defines a work cavity. The mounting means is disposed within the work cavity.

The support can conveniently include a generally planar plate with a substantially circular periphery, and the shield portion can include a substantially cylindrical shield extending from the periphery of the plate. In the preferred embodiment, the cylindrical shield is integral with the planar plate.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
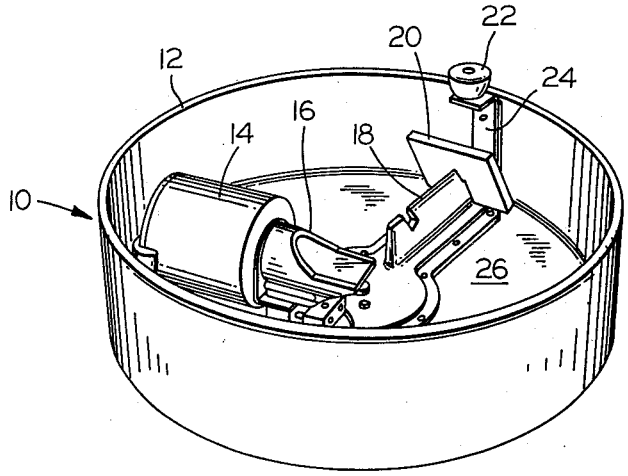
FIG. 1 is a perspective view of the rotatable subassembly of the preferred embodiment of the present invention.

The preferred embodiment of the centrifugal-casting machine of the present invention includes a rotatable subassembly 10 shown in perspective in FIG. 1. It is journaled for rotation relative to a base 80 shown in perspective in FIG. 2. Drive means described in greater detail below cause rotatable subassembly 10 to rotate relative to base 80, thereby applying centrifugal force to material in crucible 16 and mold 14 (FIG. 1). FIG. 1 illustrates a generally planar support plate 26 that has a circular periphery from which a cylindrical shield 12 extends. A work cavity is thereby defined in which mounting means are provided that mount mold 14 and crucible 16. Crucible 16 communicates with the cavity interior to mold 14 to permit the molten material in crucible 16 to flow into the interior cavity of mold 14 when rotatable subassembly 10 is rotating with a high angular velocity. Shield 12 protects bystanders in case mold 14 or crucible 16 should come loose during rotation, the annular lip at its upper edge being particularly effective at containing molten metal. The shield also tends to prevent the user of the device from putting his hands in the way of projecting rotating parts.

To properly balance the machine, a weight mount 18 is provided in which a counterbalance weight 20 is supported. Weight 20 is chosen to very nearly balance the crucible, mold, and molten material.

To operate the device, the user would typically grasp a knob 22 on a handle portion described in more detail below and rotate the rotatable subassembly 10 in the clockwise direction. As will also be described in more detail below, this winds a spring so that the user of the device imparts energy to the system. With the device so wound, the user heats material in crucible 16 and releases handle 22 while the material in crucible 16 is still in the liquid state. The potential energy in the spring is thus transformed into rotational kinetic energy in the rotatable subassembly 10, and the consequent centrifugal force forces molten material from crucible 16 into mold 14.

Figure 3:
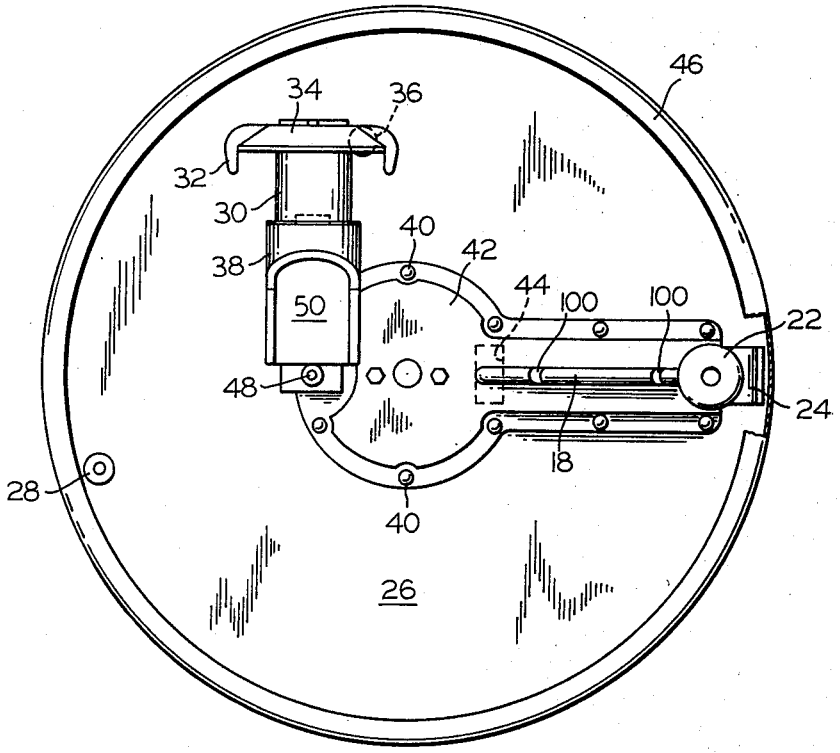
FIG. 3 is a plan view of the rotatable subassembly of the present invention showing a mold smaller than that in FIG. 1.
Figure 4:
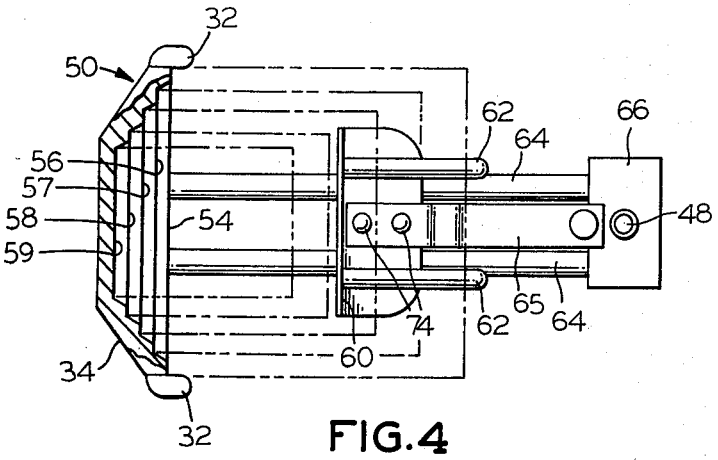
FIG. 4 is a plan view of the mounting means for the crucible and mold.
Figure 5:
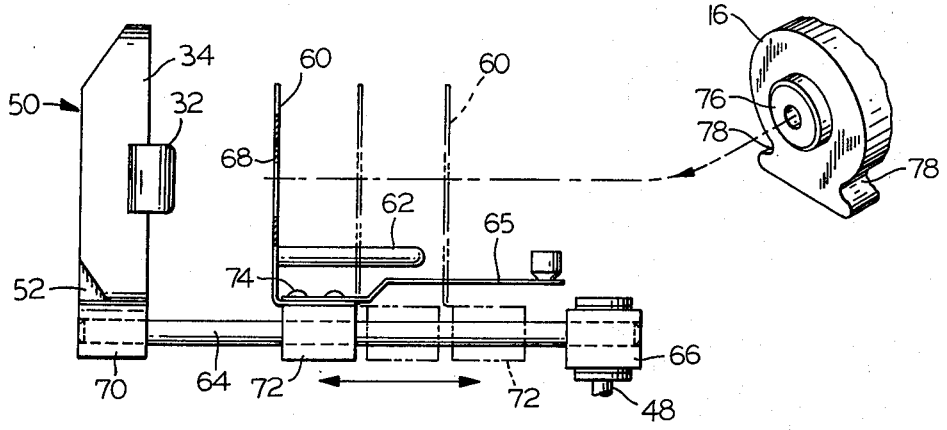
FIG. 5 is a side elevation, partly in section, of the mounting means for the crucible and mold, the end of a crucible being shown in perspective.

Means 50 for mounting a crucible and mold are illustrated to their best advantage in FIGS. 3, 4, and 5. A pivot pin 48 is received in support plate 26 and extends through a pivot block 66. Main mounting rods 64 extend from pivot block 66 through two mounting blocks 70 and 72. Mounting blocks 72 is permitted to slide along rods 64, but block 70 is fixed in position. A crucible mount is attached to mounting block 72 by suitable screws 74. The back plate 60 of the crucible mount is partially broken away in FIG. 5 to show an opening 68 that receives a raised surface 76 on the front of the crucible. Screws 74 also fasten a resiliently deflectable locking member 65 to mounting block 72.

In order to allow the crucible to be set into place on the crucible mount, locking member 65 is depressed by the user of the device. Locking member 65 is then released to hold the crucible in place. The crucible is thereby positioned by locking member 65 and by the engagement of the raised surface 76 with the periphery of opening 68 in back plate 60 of the crucible mount. Two crucible positioning rods 62 extending from back plate 60 also help to position the crucible by fitting in recesses 78 in crucible 16.

Provisions for mounting the mold include a mounting block 70 on which a mold mounting plate 34 is positioned and reinforced by a vertical rib 52. Mounting plate 34 can receive molds of several sizes, as suggested by the phantom lines in FIG. 4 and the different-sized molds 14 and 30 in FIGS. 1 and 3. The largest-sized mold is restrained laterally by a pair of ear members 32 extending from the sides of mold mounting plate 34, and its outward end rests on an annular surface 54 provided by mounting plate 34. The inner surface of mounting plate 34 is stepped to provide more restraining surfaces 56, 57, 58, and 59. Annular surfaces 56, 57, and 58 are sized to receive molds of intermediate size, while circular surface 59 receives the smallest-sized mold.

Provision for different-sized molds is also made, as the phantoms in FIG. 5 suggest, by the slidable mounting of mounting block 72 on main mounting rods 64. Although provision can be made for tightening mounting block 72 into position on mounting rods 64, such provision is absent in the preferred embodiment for the sake of simplicity; centrifugal will keep crucible 16 snugly in place against mold 14.

Mount 50 is free to pivot about the axis of pivot pin 48, and mold stops 28 and 36 (FIG. 3) are provided on support portion 26 to limit the pivoting. When the device has been wound and is then released, mount 50 is initially in the position shown in FIG. 3 because a significant component of its acceleration vector extends in the direction opposite to that in which mount 50 extends in FIG. 3. As the angular velocity of the rotatable subassembly 10 increases, however, the centripetal component of acceleration increases until all of the energy from the spring motor has been imparted to rotatable subassembly 10. At this point, the acceleration experienced by mount 50 is totally centripetal, and it has pivoted about pivot pin 48 almost to the point where it is constrained by mold stop 28. The pivoting allows the mold to tend to extend in the direction of the centrifugal force, and stops 28 and 36 limit transient swings that can result from improper initial positioning of the mold and crucible.

Figure 6:
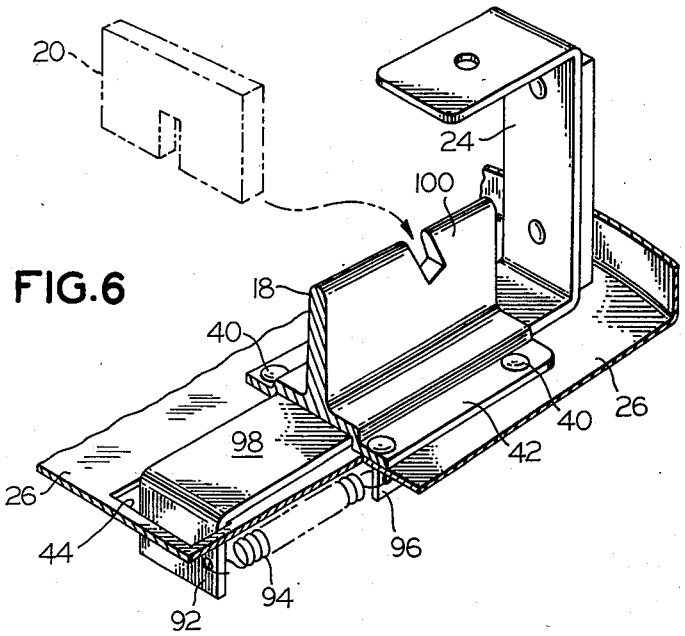
FIG. 6 is a perspective view of the handle means in position in the track means on the rotatable subassembly.

According to the present invention, the centrifugal-casting machine can be wound, locked, and released by manipulation of the same handle member, which is seen in FIG. 6 to include a handle portion 24, a body portion 98, and a projection or catch portion 92. A knob that is included in the handle member is not shown in FIG. 6. Body portion 98 of a handle member is generally planar and fits adjacent support portion 26 in a track means provided by a cover plate 42. As FIG. 3 shows, cover plate 42 has a generally circular portion fastened by rivets 40 about the center of support portion 26 and extends radially from the circular portion to provide a track means that is shown broken away in FIG. 6. The same cover plate also provides weight mount 18, which is shown in FIG. 6 to have a slot 100 provided in its upper edge to receive an appropriate weight.

Figure 8:
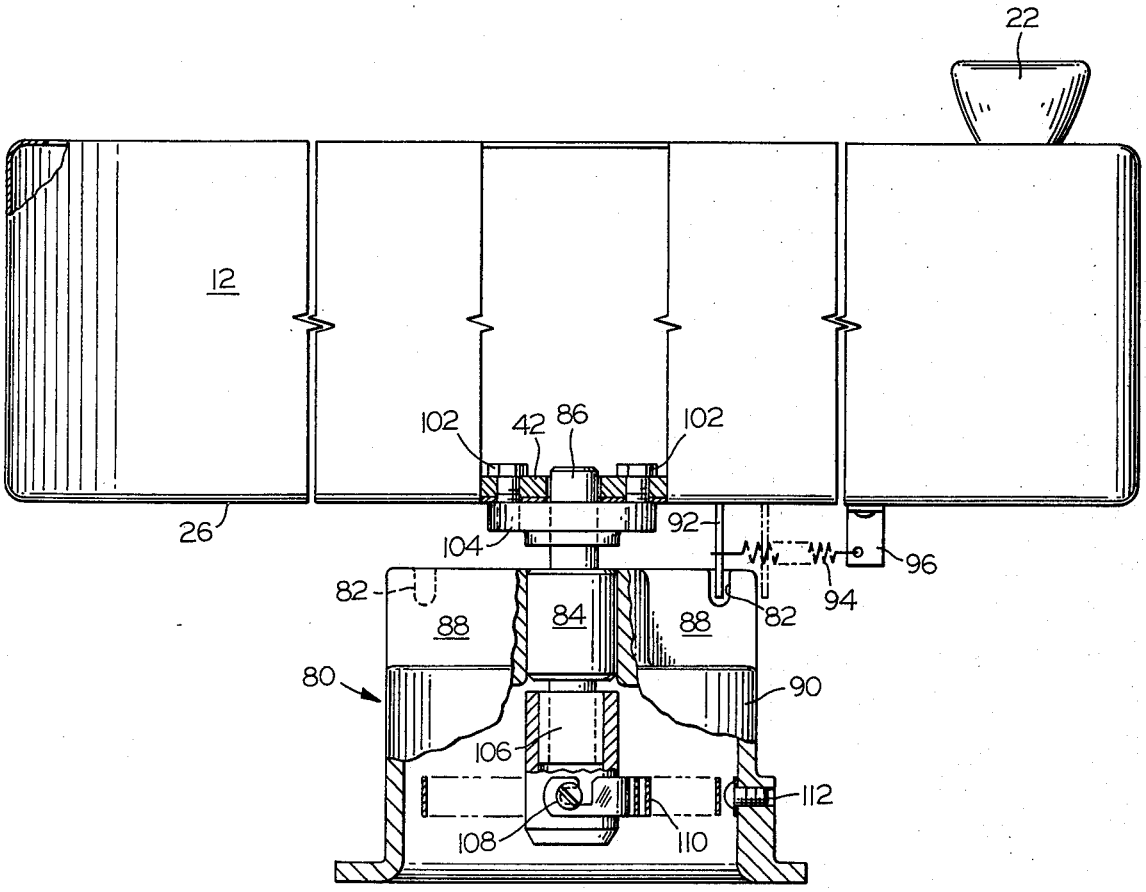
FIG. 8 is a vertical elevation, partly in section, of the preferred embodiment of the present invention.

The outer end of the handle means includes an upstanding handle portion 24 adapted for mounting a knob 22 (FIG. 8). Catch portion 92 extend downward from the inner end through opening 44 in support plate 26. The handle means is permitted to slide radially in the track means but is biased to its outward position by a bias spring 96 that is connected between catch portion 92 and a spring mounting bracket 96 depending from support plate 26.

Figure 2:
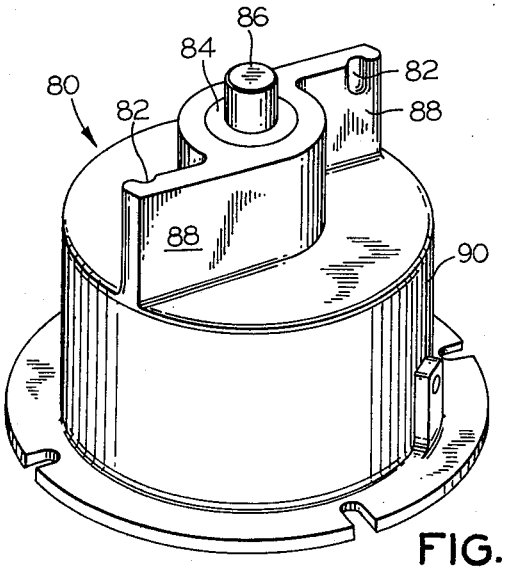
FIG. 2 is a perspective view of the base of the preferred embodiment of the present invention with the shaft of the rotatable subassembly journaled therein.
Figure 7:
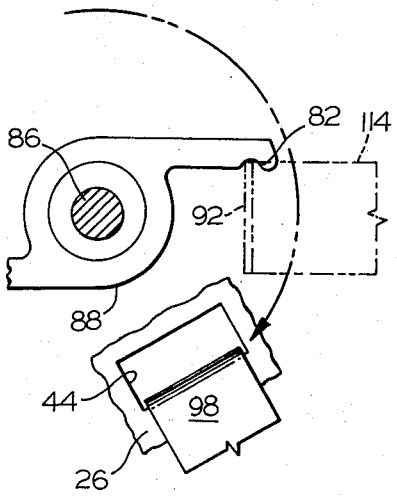
FIG. 7 is a simplified plan view of the preferred embodiment illustrating the locking means employed in the preferred embodiment.

It can be appreciated by reference to FIGS. 2 and 7 that rotatable subassembly 10 can be locked and released merely by manipulating knob 22. The upper surface of housing 90 of base 80 has upstanding ribs projecting from it that provide recesses 82 near their outer ends. FIG. 7 illustrates that, when it is in the position to which it is biased by spring 94, catch portion 92 at the inner end of body portion 98 will clear the ribs on base 80 and thus allow rotatable subassembly 10 to rotate freely, as it will be urged to do when the sping motor is wound. However, after the user has wound the spring motor, he will want to have his hands free so that he can heat the material in the crucible. Accordingly, he pushes inwardly on knob 22, overcoming the bias of spring 94 and causing the handle means to move inwardly to the position designated by phantom 114 in FIG. 7, in which catch portion 92 of the handle means is received in one of the recesses 82 in the ribs projecting from housing 90. The wound spring motor urges catch portion 92 into recess 82 and therefore prevents it from moving outwardly and releasing rotatable subassembly 10. Rotatable subassembly 10 is thus locked into place, which frees the user's hands to perform other tasks, such as the heating of the material in the crucible. When the heating operation is finished, the user merely urges knob 22 slightly in the clockwise direction, allowing it to assume the outer position to which it is biased by spring 94, and releases it to allow rotatable subassembly 10 to spin and thereby force the material from the crucible into the mold. Thus, both locking and release are performed by the manipulation of one knob by one hand.

The mechanism for spinning the machine is best appreciated by reference to FIG. 8, which is a partially broken away vertical elevation of the device. The shell of the rotatable subassembly is designated in FIG. 8 by reference numerals 12 and 26, which refer to the shield and support portions respectively. In this arrangement, in which shield 12 rotates as part of the rotatable subassembly, considerable simplicity of manufacture is permitted because a shell consisting of the shield and the base portion can be made in one piece. This lowers the part count and reduces the time required for assembly.

The rotatable subassembly includes a shaft 86 that is rigidly fastened to a coupling plate 104, and suitable bolts 102 hold cover plate 42 and support portion 26 to coupling plate 104. Thus, support portion 26 rotates with shaft 86. Shaft 86 is journaled in a bearing 84 that fits in a portion of housing 90 extending from its upper surface. Shaft 86 extends through bearing 84 into a clutch 106 that is fastened by screw 108 to one end of motor spring 110. The other end of motor spring 110 is fastened by screw 112 to housing 90 of base 80.

Clutch 106 permits slippage in one direction but not in the other. When shaft 86 rotates in the clockwise direction, clutch 106 rotates with it and thereby winds motor spring 110. Thus, the spring can be wound by rotation in the clockwise direction, and the spring can give up its energy to the shaft by urging it in the counterclockwise direction. However, after spring 110 has completely unwound, it is not wound again in the opposite direction by the continued rotation of shaft 86 in the counterclockwise direction, because clockwise slippage of shaft 86 relative to spring 110 is permitted. After all of the spring energy has been imparted to rotatable subassembly 10, therefore, rotatable subassembly 10 cna continue to spin without resistance from spring 110.

In summary of the operation partially described at several points above, the user of the centrifugal-casting machine illustrated in the accompanying drawings would typically charge the material into crucible 16 as the first step in the operation. He would then grasp handle 22 and rotate rotatable subassembly 10 in the clockwise direction. Clutch 106 does not permit clockwise motion of shaft 86 relative to the inner end of spring 110, so this clockwise rotation winds motor spring 110. When motor spring 110 is wound sufficiently, the user pushes inward on knob 22, which causes body portion 98 of the handle means to slide in the track provided by cover plate 42. This moves catch 92 radially inward to the radial position of recesses 82. The user then allows a small counterclockwise rotation that engages catch 92 in recess 82. Catch 92 and the upstanding rib 88 that provides recess 82 thus act as cooperating locking means, preventing rotatable subassembly 10 from rotating in the counterclockwise direction urged by motor spring 110.

The charge in crucible 116 is then heated, typically by a torch. It should be noted that with the advantageous arrangement shown in the drawings, the user can employ one hand for winding, locking, and unlocking and leave the other hand free for holding the torch. (Of course, both hands are free when the rotatable subassembly is locked.) Once the charge is in its molten state, the user rotates rotatable subassembly 10 slightly in the clockwise direction to permit the handle means to move radially outward under the force from bias spring 94. Knob 22 is then released, rotatable subassembly 10 spins, and the charge from the crucible flows into the mold. The typical duration of spin is great enough to allow the molten charge to harden in the mold.

It can be appreciated by referring to FIG. 1 that the use of a shield that rotates with the rotatable subassembly not only contributes to a lower cost and ease of manufacture but also contributes a degree of safety.

Shield 12 can be located very close to the rotating parts; indeed, it is part of the rotatable subassembly. Accordingly, it is much less likely that much of the user's arm will be inside the shield during the winding operation. Furthermore, the arrangement of support plate 26 and shield 12 allows a disposition of rotating parts such that the projection of the parts from the surfaces of support plate 26 and shield 12 is kept at a minimum. Thus, the likelihood is further reduced that a projecting part will catch the user's hand or other body part; the other extent of the rotating subassembly consists of a smooth shell. This safety is further contributed to by the fact that the winding, locking, and release functions are all performed by manipulation of knob 22. Since only one hand is needed for these operations, it is thought that a lower level of concentration is required to avoid injury than would be required if, for instance, two hands were required for the locking operation. Accordingly, a centrifugal-casting machine arranged according to the teachings of the present invention provides simplicity and safety of operation in a device whose simple construction permits it to be sold in a price range within the reach of most hobbyists.

Having thus described the invention, I claim:

1. A centrifugal-casting machine comprising:

a. a base;

b. a rotatable subassembly journaled in said base for rotation relative to said base about an axis and having mounting means thereon spaced transversely from said axis and adapted for mounting a centrifugal-casting crucible and mold;

c. drive means including drive spring means, said drive means being operatively connected to said base and said rotatable subassembly for winding of said drive spring means by rotation of said rotatable subassembly relative to said base in one direction and for urging of said rotatable subassembly in the other direction by said drive spring means when it is wound, said drive means permitting said rotatable subassembly to rotate in the other direction without winding said drive spring means;

d. handle means including a handle portion adapted to be manually gripped by the user, said handle means being slidably mounted on said rotatable subassembly for sliding movement radially thereof from a first position, in which said handle portion is spaced farther from said axis, to a second position, in which said handle portion is positioned closer to said axis; and e. cooperating locking means on said base and said handle means, said locking means being engageable upon movement of said handle means to said second position to prevent rotation of said rotatable subassembly relative to said base in said other direction and disengageable upon movement of said handle means to said first position to permit such rotation, whereby winding, locking, and release can all be effected by manipulation of said handle means.

2. The centrifugal-casting machine of claim 1 wherein said locking means includes a catch portion of said handle means extending therefrom and a stop portion of said base positioned to obstruct movement of said catch portion about said axis when said handle portion is in said second position but to permit movement of said catch portion when said handle portion is in said first position.

3. The centrifugal-casting machine of claim 2 wherein said rotatable subassembly includes a generally planar plate portion extending substantially perpendicularly to said axis, having an opening therethrough at least part of which is spaced from said axis, and including track means thereon extending substantially radially from said opening, and wherein said handle means include a body portion received in said track means for guiding of said handle means by said tract means radially of said axis, said catch portion of said handle means extending in one direction transversely of said body portion from one end thereof through said opening, said handle portion of said handle means extending in the other direction transversely of said body portion from the other end of said body portion.

4. The centrifugal-casting machine of claim 3 further including bias means biasing said handle means to said first position thereof.

5. The centrifugal-casting machine of claim 4 wherein said base includes a housing having a generally planar upper surface and at least one upstanding rib projecting from said upper surface and extending from said axis toward the periphery of said upper surface, said rib extending a predetermined limit distance from said axis, and wherein said catch portion of said handle means is spaced more than said limit distance from said axis when said handle means is in said first position and less than said limit distance from said axis when said handle means is in said second position.

6. The centrifugal-casting machine of claim 5 wherein said housing of said base includes a second upstanding rib projecting from said upper surface and extending approximately in the direction opposite said first-mentioned rib from said axis toward the periphery of said upper surface, said second rib extending approximately said predetermined limit distance from said axis.

7. The centrifugal-casting machine of claim 1, 2, 3, 4, 5, or 6 wherein said rotatable subassembly includes shaft means journaled in said base for rotation about said axis, wherein one end of said drive spring means is fastened to said base, and wherein said drive means include clutch means coupled between said shaft and the other end of said drive spring means for permitting said shaft to slip relative to said other end of said drive spring means in one direction but prevent it from slipping relative to the other end of said drive spring means in the other direction, winding of said drive spring means by rotation of said rotatable subassembly thereby being possible in only one direction.

8. A method of operating a centrifugal-casting machine comprising the steps of:

a. providing a centrifugal-casting machine that includes:

(i) a base;

(ii) a rotatable subassembly journaled in said base for rotation relative to said base about an axis and having mounting means thereon spaced transversely from said axis and mounting a centrifugal-casting crucible and mold;

(iii) drive means including drive spring means, said drive means being operatively connected to said base and said rotatable subassembly for winding of said drive spring means by rotation of said rotatable subassembly relative to said base in one direction and for urging of said rotatable subassembly in the other direction when said drive spring means is wound, said drive means permitting said rotatable subassembly to rotate in the other direction relative to said base without winding said drive spring means;

(iv) handle means including a handle portion adapted to be manually gripped by the user, said handle means being slidably mounted on said rotatable subassembly for sliding movement radially thereof from a first position in which said handle portion is spaced farther from said axis to a second position in which said handle portion is positioned closer to said axis; and (v) cooperating locking means on said base and said handle means, said locking means being engageable upon movement of said handle portion to said second position to prevent rotation of said rotatable subassembly relative to said base in said other direction and disengageable upon movement of said handle means to said first position to permit such rotation, whereby winding, locking, and release of said centrifugal-casting machine are all possible by manipulation of said handle means;

b. with said handle means in said first position, urging said handle portion about said axis in said one direction, thereby winding said drive spring means;

c. moving said handle portion to said second position to engage said cooperating locking means;

d. heating a charge of material in said crucible to a molten state;

e. moving said handle portion to said first position; and f. releasing said handle portion of said handle means, thereby permitting said drive means to rotate said rotatable subassembly.

* * * * *